US006290542B1

(12) United States Patent
Kuo

(10) Patent No.: US 6,290,542 B1
(45) Date of Patent: Sep. 18, 2001

(54) CABLE END CONNECTOR

(75) Inventor: Peter Kuo, Chung-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/466,238

(22) Filed: Dec. 17, 1999

(51) Int. Cl.[7] ..... H01R 13/648
(52) U.S. Cl. ..... 439/610
(58) Field of Search ..... 439/497, 610

(56) References Cited

U.S. PATENT DOCUMENTS 4,971,574 * 11/1990 Garcia ..... 439/497
5,716,229 * 2/1998 Loder et al. ..... 439/497

* cited by examiner

*Primary Examiner*—Gary Paumen
(74) *Attorney, Agent, or Firm*—Wei Te Chung

(57) ABSTRACT

A cable end connector comprises an insulative housing, an upper and a lower shied member. The insulative housing defines a plurality of passageways therein and a pair of shoulders extending from lateral sides thereof. A flat cable comprises a plurality of wires for electrically connecting with the cable end connector. A conductive plastic tape shrouds the end of the flat cable for providing EMI protection. The upper and lower shield members are made from metal plate. A plurality of resilient plates respectively extends from the flat body thereof. The flat body of each shield member forms a pair of side walls perpendicularly extending from lateral edges thereof. The flat body of each shield member forms a contacting plate respectively extending from front edge thereof for electrically contacting the conductive plastic tape. A pair of flat ears perpendicularly extends from lateral sides of the flat body. A pair of stepped ears perpendicularly extends from lateral sides of the flat body corresponding to the flat ears.

1 Claim, 4 Drawing Sheets

CABLE END CONNECTOR

BACKGROUND OF THE INVENTION

The present invention relates to a cable end connector, and particularly to a cable end connector having a shield mechanism for use with a flat cable.

U.S. Pat. Nos. 3,854,787, 3,861,775, 4,767,345 and Taiwan Patent Application No. 78106838 each disclose a conventional cable end connector for connecting with a flat cable. However, none of these conventional cable end connectors provides a shield mechanism for shielding the connecting portion of the cable end connector and the flat cable. This means that the plurality of wires of the flat cable is exposed to EMI at the connecting portion, and thus signal transmission may be interfered with.

Another cable end connector is disclosed in Taiwan Patent Application No. 81201975. Although a shield member is disclosed in this invention for EMI, this shield member is just designed for round cable. A conductive material is commonly provided in a shroud at the end of a flat cable to shield against EMI when the width of the cable end connector is equal to the width of the flat cable. However, when the width of the cable end connector is wider than the width of the flat cable, the conventional invention can not provide reliable EMI protection.

Referring to FIG. 1, a conventional cable end connector 7 has an insulative housing 70 defining a plurality of passageways 71 for electrically connecting to corresponding wires 80 of a flat cable 8. A conductive material 9 surrounds the end of flat cable 8, thereby providing EMI protection. However, the width of the insulative housing 70 is wider than the width of the flat cable 8, and the conductive material 9 can not shroud the end of the wires 80. Therefore, signal transmission between the flat cable 8 and the cable end connector 7 may be interfered with.

Thus there is a need for an improved cable end connector to overcome the above mentioned problem.

BRIEF SUMMARY OF THE INVENTION

A main object of the present invention is to provide a cable end connector having a shield member for providing protection against EMI during signal transmission.

Another object of the present invention is to provide a shield member that can be easily assembled to a cable end connector.

To fulfill the above-mentioned objects, a cable end connector according to the present invention comprises an insulative housing and an upper and a lower shield members. The insulative housing defines a plurality of passageways for receiving a plurality of terminals therein and forms a pair of shoulders extending from lateral sides thereof. A flat cable comprises a plurality of wires for electrically connecting with corresponding terminals of the cable end connector. A conductive plastic tape shrouds the end of the flat cable for providing EMI protection. The upper and lower shield members are made from metal plate and each shield member comprises a flat body. A plurality of resilient plates respectively extends from each flat body. The flat body of each shield member forms a pair of side walls perpendicularly extending from lateral edges thereof. The side wall of the upper shield member defines a pair of holes, and the side wall of the lower shield member defines a pair of projections for locking with the holes. The flat body of each shield member forms a contacting plate respectively extending from a front edge thereof. A pair of flat ears perpendicularly extends from lateral sides of the upper shield member. A pair of stepped ears perpendicularly extends from lateral sides of the lower shield member corresponding to the flat ears of the upper shield member.

Thus, the upper and lower shield members are easily assembled to the cable end connector and then provide EMI protection during signal transmission.

Other objects, advantages and novel features of the invention will become more apparent from the following detailed description when taken in conjunction with the accompanying drawings.

DETAILED DESCRIPTION OF THE INVENTION

Figure 1:
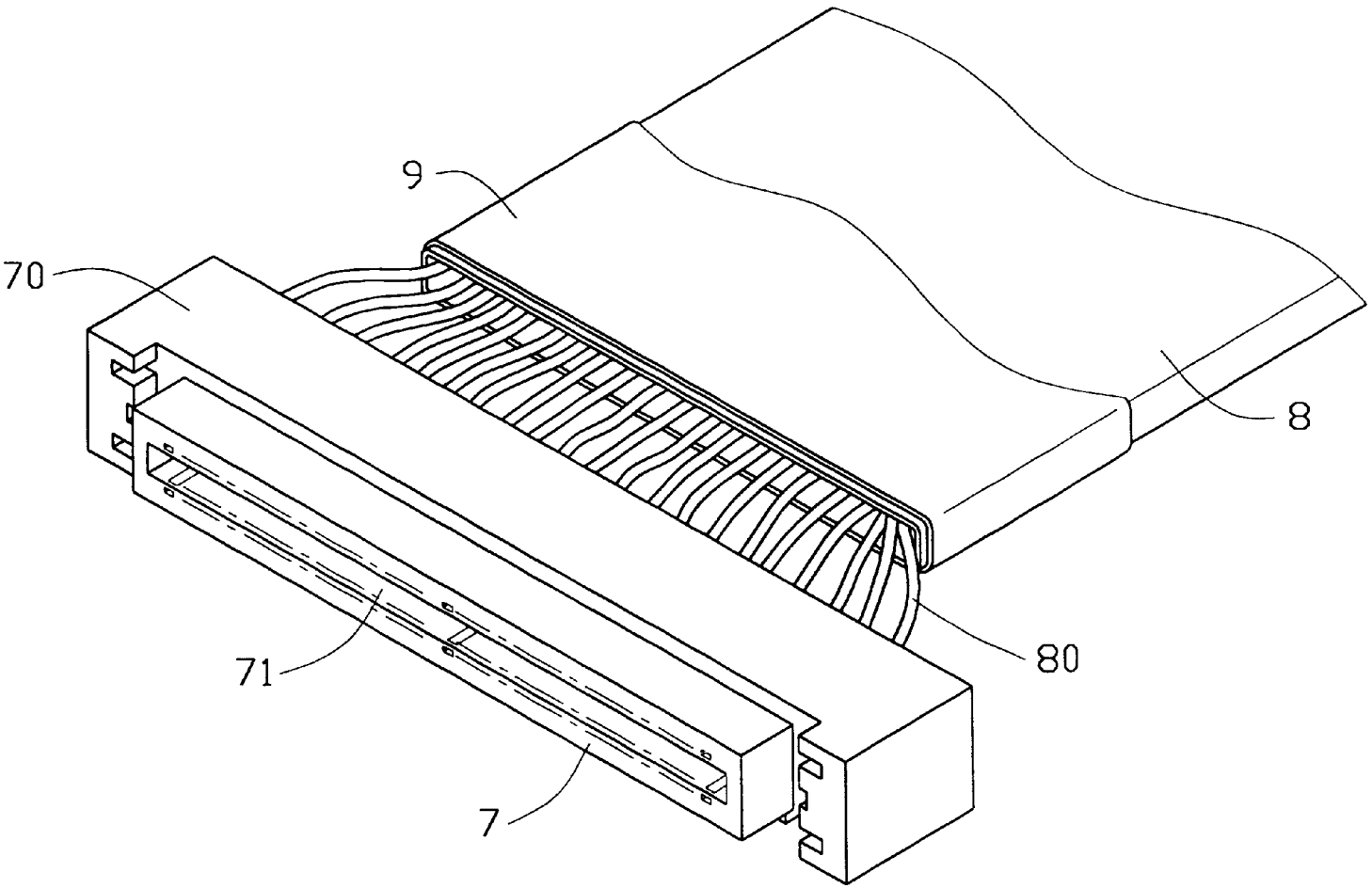
FIG. 1 (PRIOR ART)
FIG. 1 is a perspective view of a conventional cable end connector assembled with a flat cable.
Figure 2:
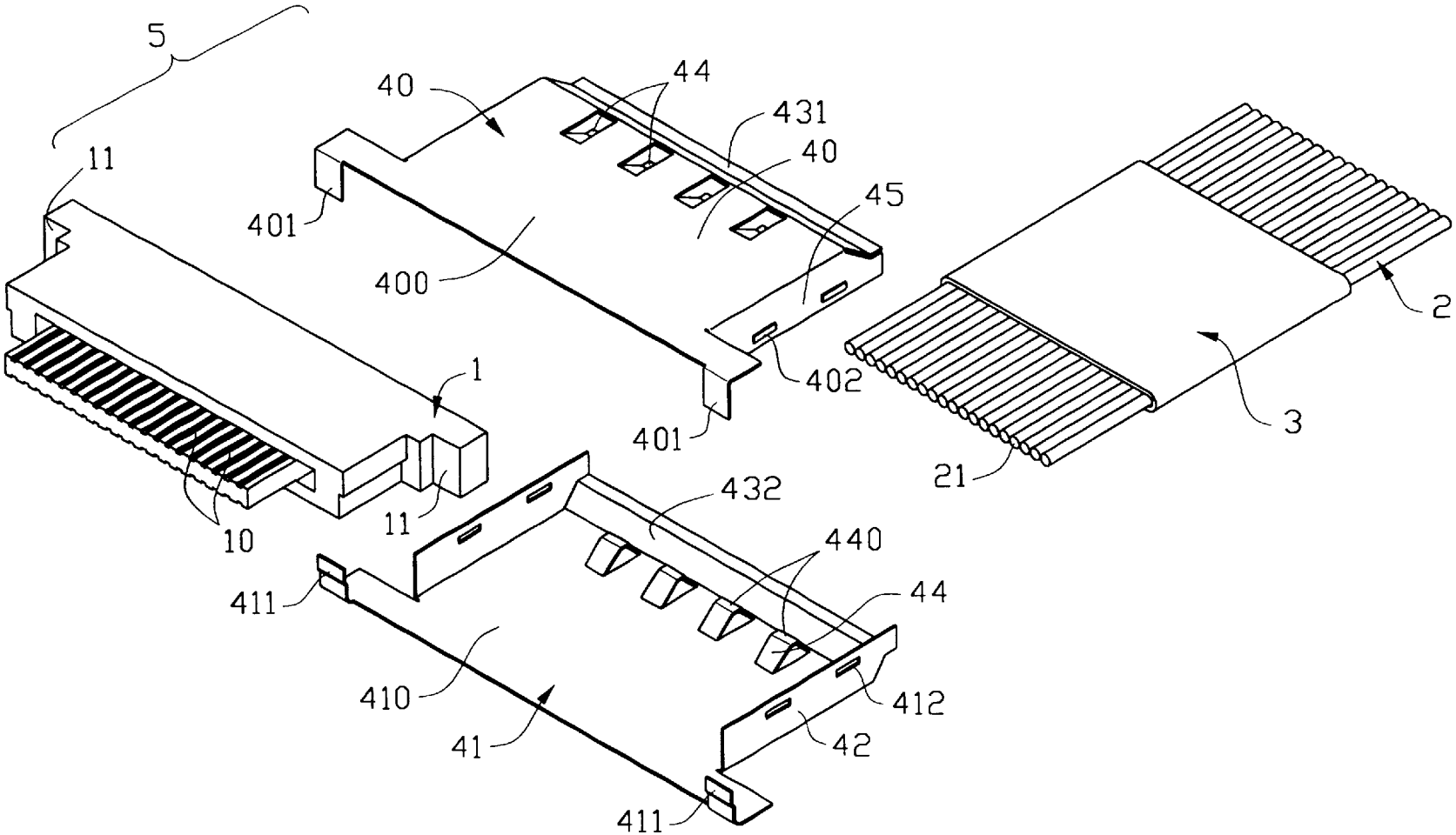
FIG. 2 is an exploded view of a cable end connector in accordance with the present invention and a flat cable.

Referring to FIG. 2, a cable end connector 5 of the present invention comprises an insulative housing 1 and an upper and a lower shield members 40, 41. The insulative housing 1 defines a plurality of passageways 10 for receiving a plurality of terminals therein and forms a pair of shoulders 11 extending from lateral sides thereof. A flat cable 2 comprises a plurality of wires 21 for electrically connecting with corresponding terminals of the cable end connector 5. A conductive plastic tape 3 shrouds the flat cable 2 for providing EMI protection. The upper and lower shield member 40, 41 are made from metal plate and each comprises a flat body 400, 410. A plurality of resilient plates 44 respectively extends from each flat body 410, 400, and a folded tip 440 is formed at each end thereof. The flat bodies 400, 410 each form a pair of side walls 45, 42 perpendicularly extending from lateral edges thereof. The side wall 45 defines a pair of holes 402, and the side wall 42 defines a pair of projections 412 corresponding to the holes 402. The flat body 400 extends downwardly a contacting plate 431 from a front edge thereof. The flat body 410 extends upwardly a contacting plate 432 from a front edge thereof. The upper and lower shield members 40, 41 define a first space (not labeled) between the flat body 400 and the flat body 410 and a second space (not labeled) around front edge portions of the contacting plates 431, 432, the second space being dimensioned to allow the flat cable to snugly extend therethrough. The resilient plates 44 of the upper shield members and the lower shield members extend inwardly to the first space. A pair of flat ears 401 perpendicularly extends from lateral sides of the flat body 400. A pair of stepped ears 411 perpendicularly extends from lateral sides of the flat body 410 corresponding to the flat ears 401.

Figure 3:
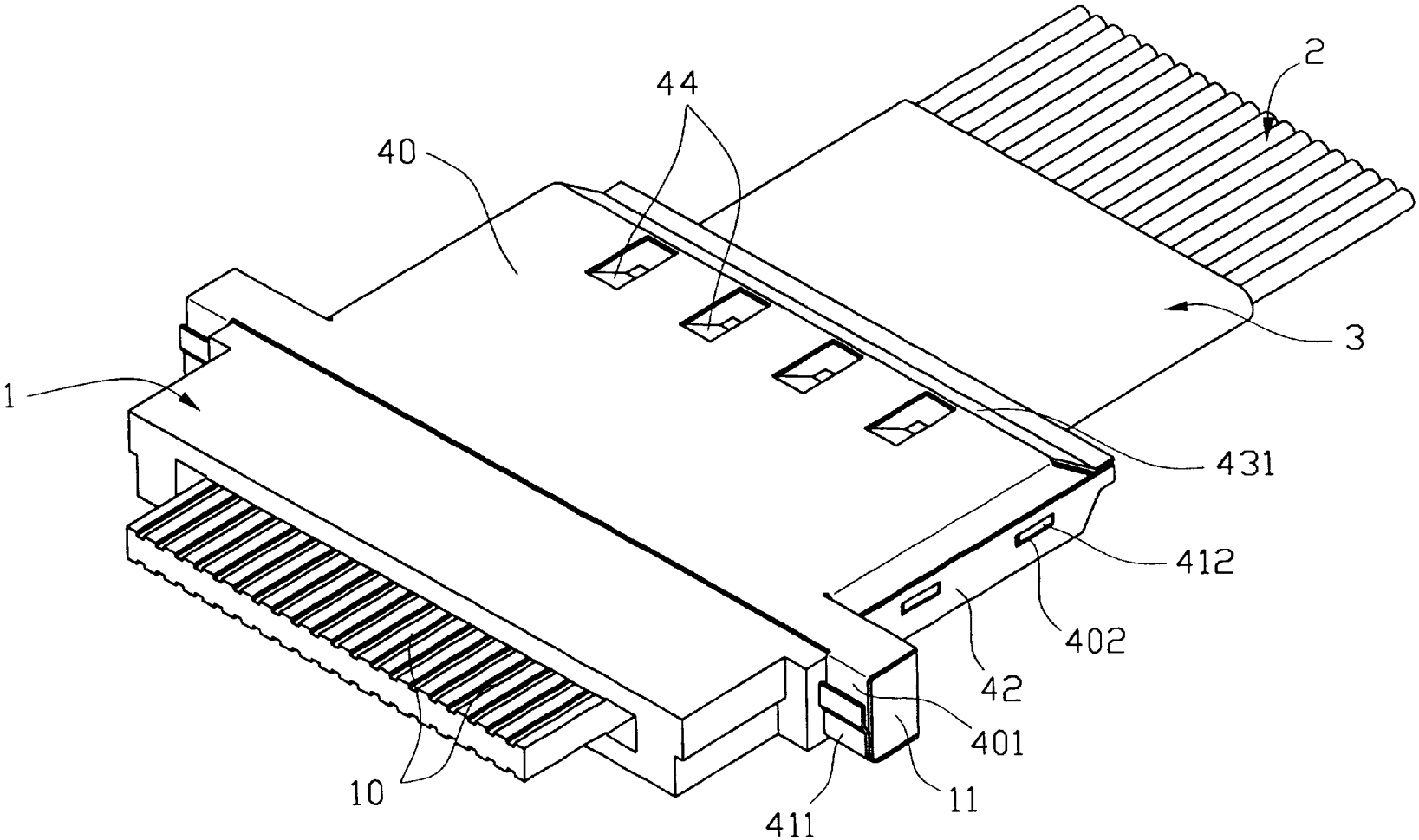
FIG. 3 is a perspective view of the cable end connector of FIG. 2 assembled with the flat cable.
Figure 4:
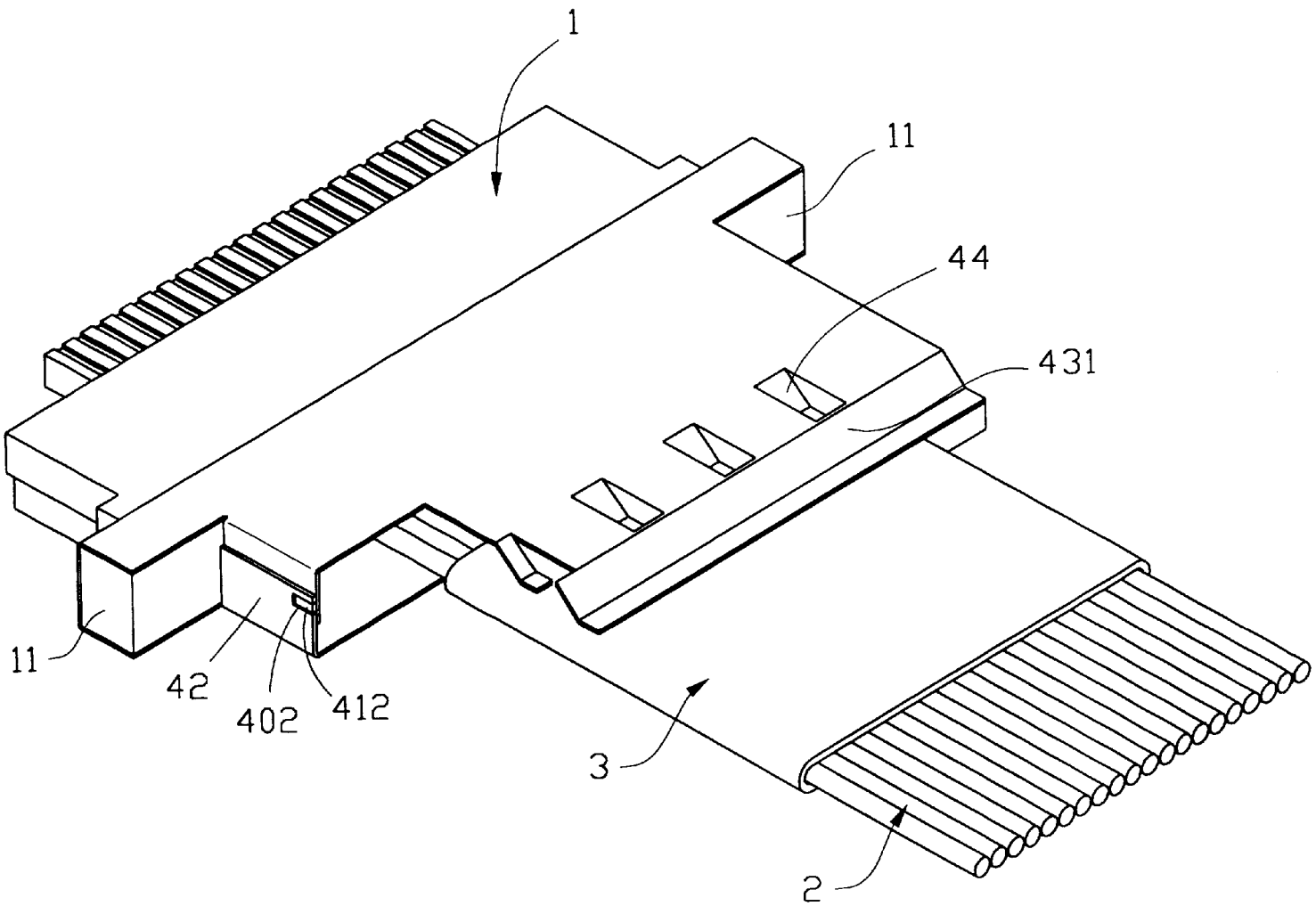
FIG. 4 is a perspective, partial-sectional view of the cable end connector of FIG. 2 assembled with the flat cable.

Referring to FIGS. 3 and 4, after assembly, the upper and lower shield members 40, 41 together cover the insulative housing 1. The projections 402 lock with corresponding holes 412. The flat ears 401 are assembled between the stepped ears 411 and the shoulders 11. In this way, the upper and lower shield members 40, 41 can be easily assembled to the insulative housing 1. The contacting plates 431, 432 electrically contact the conductive plastic tape 3 for discharging static electricity accumulated thereon.

Furthermore, for providing a reliable engagement between the shield members 40, 41 and the conductive plastic tape 3, the resilient plates 44 are respectively folded to electrically contact the conductive plastic tape 3. Therefore, an effective EMI shield is provided and signal transmission between the flat cable 2 and the cable end connector 5 is more reliable.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly comprising:

a flat cable comprising a plurality of wires and a conductive plastic tape shrouding the wires; and a cable end connector comprising:

an insulative housing defining a plurality of passageways for receiving corresponding terminals therein; and an upper and a lower metal shield member assembled to cover the insulative housing therein, each shield member forming a pair of side walls perpendicularly extending from lateral edges thereof, the upper shield member having a contacting plate extending downwardly from a front edge thereof and the lower shield member having a contacting plate extending upwardly from a front edge thereof and directly electrically contacting the conductive plastic tape, each shield member comprising a flat body, a plurality of resilient plates extending from each flat body inwardly and directly contacting the conductive plastic tape;

wherein the upper shield member forms a pair of flat ears extending from lateral edges thereof for assembling to a pair of stepped ears extending from lateral edges of the lower shield member;

wherein the side walls of the upper shield member define a plurality of projections for locking with corresponding holes defined in the side walls of the lower shield member;

wherein a bent tip is formed at an end of each of the resilient plates.

* * * * *